United States Patent [19]

Wheeler

[11] 4,140,306

[45] Feb. 20, 1979

[54] FIXTURE FOR MOUNTING AN ARTICLE TO BE WORKED ON

[75] Inventor: Jack H. Wheeler, Minneapolis, Minn.

[73] Assignee: Head Engineering, Inc., Blaine, Minn.

[21] Appl. No.: 842,456

[22] Filed: Oct. 17, 1977

[51] Int. Cl.[2] ..... B25B 1/22

[52] U.S. Cl. ..... 269/47; 269/15; 269/69; 269/71

[58] Field of Search ..... 269/47, 69, 70, 71, 269/73, 236, 15

[56] References Cited

U.S. PATENT DOCUMENTS

| | | | |
|---|---|---|---|
| 426,341 | 4/1890 | Strong | 269/73 |
| 1,625,251 | 4/1927 | Fodge | 269/236 |
| 2,106,525 | 1/1938 | Henry | 269/70 |
| 2,737,709 | 3/1956 | Lovelace | 269/47 |
| 2,969,231 | 1/1961 | Mills | 269/69 |
| 3,048,387 | 8/1962 | Waggoner | 269/71 |
| 4,010,942 | 3/1977 | Ward | 269/15 |

*Primary Examiner*—Robert C. Watson
*Attorney, Agent, or Firm*—Wicks & Nemer

[57] ABSTRACT

A fixture for mounting an article to be worked on including a base having an end member together with an arm pivotally mounted on the end member. The end member is formed with a multiplicity of spaced holes on radii extending from the pivot point of said arm, and the arm has a spring urged pin for engagement in any of said holes whereby the arm may be selectively positioned. Rotatable and slidably mounted on one end of the arm is a supporting arm which has a slot formed therein in which screw members are selectively positioned for threaded engagement with an article.

3 Claims, 3 Drawing Figures

FIXTURE FOR MOUNTING AN ARTICLE TO BE WORKED ON

SUMMARY

The invention relates to an improvement in a fixture for mounting an article to be worked on. For example, in an engine repair shop the head of an internal combustion engine may require certain work thereon. To work on any given part of the head in the most efficient manner the head should be securely positioned in the best attitude for the work to be done. It is therefore an object of the invention to provide a fixture on which an article to be worked on may be positioned in a multitude of positions.

A base is provided on which is secured an end member, and pivotally mounted on the end member is an arm which is secureable in various pivoted positions relative to the end member. A support arm is also provided which is rotatably and slidably mounted in clamping engagement on an end of the pivotal arm. The support arm is formed with a slot extending longitudinally thereof and through which hand manipulated threaded members extend for threaded engagement with threaded holes in an article to be supported and worked on. It will be seen that with the above construction of the fixture that an article connected to the support arm may be positioned in a great variety of selectable positions.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
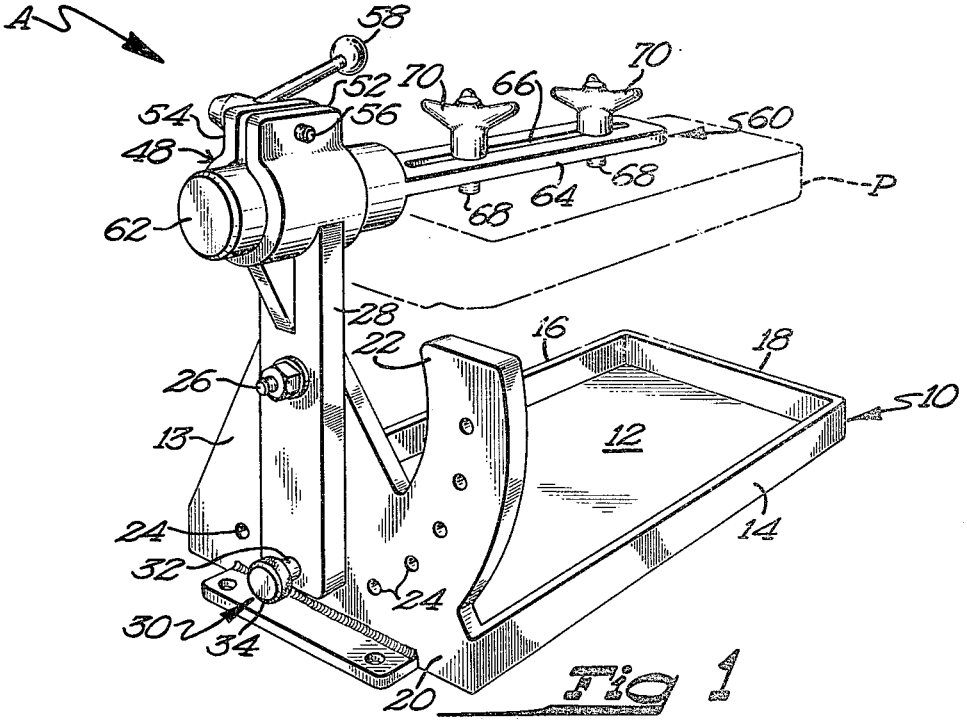
FIG. 1 is a perspective view of a fixture for mounting engine parts and the like embodying the invention with a part simulated in broken lines.
Figure 2:
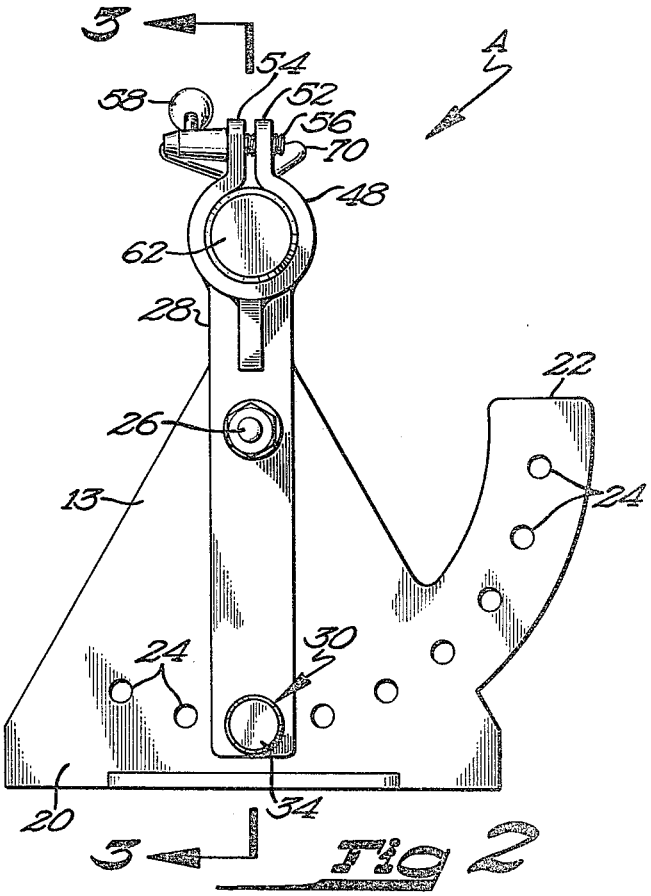
FIG. 2 is an end view thereof with the pivotal arm shown in full line in one position and in a further selected position in broken lines.
Figure 3:
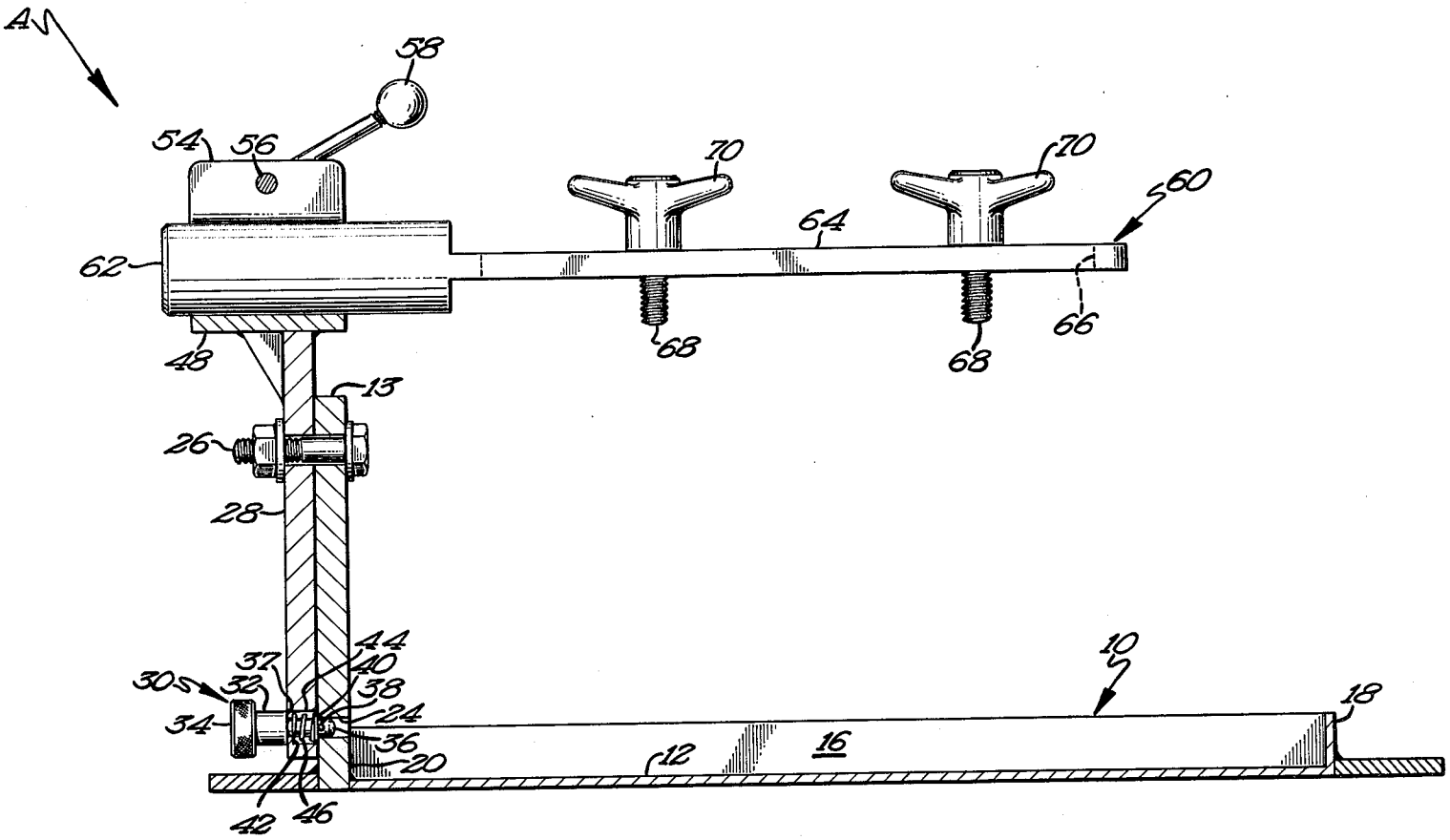
FIG. 3 is a sectional view on the line 3—3 of FIG. 2.

Referring to the drawings in detail the fixture A includes the base 10 formed of the flat rectangular bottom 12, and formed on the edges of the bottom are the upstanding sidewalls 14 and 16 together with the upstanding end walls 18 and 20; the walls and bottom forming a kind of catch basin. The end wall 20 terminates at its upper edge in the end portion 13 which is somewhat triangular in form. Extending from the end portion 13 at one side edge thereof is the arcuate segment portion 22.

The end portion 13 and the segment 22 have formed therein the spaced holes 24 formed in an arc with equal radii about the pivot pin 26 mounted on the end portion 13. Further provided is the arm 28 pivotally mounted intermediate its ends on the pivot pin 26 for swinging movement in the arc of the holes 24. The lower end of the arm 28 is provided with the spring urged pin 30 which includes the shank 32 and head 34. The shank 32 terminates in the reduced pin portion 36 thereby forming the shoulder 37 and through which is secured the transverse pin 38. Positioned against the pin 38 is the washer 40, and mounted on the pin portion 36 between the washer 40 and the shoulder 42 formed in the hole 44 formed in the arm 28 is the coil spring 46 which normally urges the pin 30 into a hole 24 to maintain the arm in a selected position on the end portion 13.

The upper end of the arm 28 has formed thereon the arcuate split clamping member 48 on which are formed the parallely disposed extensions 52 and 54, respectively. The clamping member 48 is brought together in clamping relationship by means of the threaded bolt 56 extended through extension 54 and engaging threads in the extension 52 with the bolt 56 having formed thereon the right angular disposed handle 58 to aid in manipulation of the bolt 56.

The numeral 60 designates a support arm overlying the base and which includes the cylindrical end portion 62 slidably mounted within the clamping collar 48 so that the supporting arm adjustably overlies the base, and extending from the end portion 62 is the elongated flat blade portion 64. The support arm may be rotated about its longitudinal axis on the cylindrical end portion 62 or slidably moved within the clamp 48. The blade portion 64 has formed therethrough the longitudinally extending slot 66 in which the engagement screws 68 extend for adjustable positioning within the slot and engagement with threaded holes in an item to be supported on the arm. The screws 68 have formed thereon the head 70 for easy turning of the screws 68.

OPERATION

In use of the fixture A an article to be worked on and illustrated as P in broken lines is secured to the support arm by means of the screws 68 which are slidable in the slot 66 to accommodate threaded holes in the article and the size of the article. Further the support arm may be rotated on the cylindrical portion 62 and slidably moved within the clamp member 48. Additionally, the arm 28 may be pivoted on the pin 26 and locked into the pivoted position by the pin 32 in engagement with any of the holes 24 to further allow the exact position of the article P as desired.

Having thus described the invention, what is claimed as new and desired to be secured by Letters Patent is:

1. A fixture for mounting an article to be worked on comprising:

(a) an elongated base having, (b) an end member connected thereto at one end, (c) an arm, (d) means pivotally mounting said arm on said end member, (e) means for securing said arm in selected pivoted position on said end member, (f) an elongated supporting arm, (g) means rotatably mounting said elongated supporting arm on said arm normal thereto and overlying said base in parallel relation to said base, (h) means for securing an article to said elongated supporting arm, and, (i) means for removably securing said rotatably mounting means of said elongated supporting arm on said end member, said means pivotally mounting said arm on said end member including a pin freely extended through said arm intermediate the ends thereof and fixed to said end member, said means for securing an article to said elongated supporting arm including (j) a slot formed therethrough, and (k) engagement screws carried in said slot.

2. A fixture for mounting an article to be worked on comprising:

(a) an elongated base having, (b) an end member connected thereto at one end, (c) an arm,
(d) means pivotally mounting said arm on said end member,
(e) means for securing said arm in selected pivoted position on said end member,
(f) an elongated supporting arm,
(g) means rotably mounting said elongated supporting arm on said arm normal thereto and overlying said base in parallel relation to said base.
(h) means for securing an article to said elongated supporting arm, and,
(i) means for removably securing said rotatably mounting means of said elongated supporting arm on said end member,
said means for securing an article to said elongated supporting arm including
(j) a slot formed therethrough, and
(k) engagement screws carried in said slot.

3. A fixture for mounting an article to be worked on comprising:
(a) an elongated base having,
(b) an end member connected thereto at one end,
(c) an arm,
(d) means pivotally mounting said arm on said end member,
(e) means for securing said arm in selected pivoted position on said end member,
(f) an elongated supporting arm,
(g) means rotatably mounting said elongated supporting arm on said arm normal thereto and overlying said base in parallel relation to said base,
(h) means for securing an article to said elongated supporting arm, and,
(i) means for removably securing said rotatably mounting means of said elongated supporting arm on said end member,
said means for rotatably mounting said elongated supporting arm on said send member including
(j) said elongated supporting arm having a cylindrical end,
(k) mounted in an arcuate member mounted on said arm,
said means for removably securing said rotatably mounting means of said elongated supporting arm on said end member including a clamp formed on said means rotatably mounting elongated supporting arm.

* * * * *